US005375909A

United States Patent [19]

Lee

[11] Patent Number: 5,375,909

[45] Date of Patent: Dec. 27, 1994

[54] COMPLEX CHAIR DEVICE

[76] Inventor: Ming-Hsen Lee, No.33, Shin-Ai Rd., Tainan City, Taiwan, Prov. of China

[21] Appl. No.: 185,496

[22] Filed: Jan. 24, 1994

[51] Int. Cl.[5] ..... A47C 3/20

[52] U.S. Cl. ..... 297/237; 248/157; 297/338

[58] Field of Search ..... 297/344.12, 237, 338; 108/93, 96; 248/157, 161

[56] References Cited

U.S. PATENT DOCUMENTS

| | | | |
|---|---|---|---|
| 735,312 | 8/1903 | Stokes | 106/96 |
| 1,946,826 | 2/1934 | Agati | 297/237 X |
| 2,058,299 | 10/1936 | Cook | 297/237 X |
| 4,438,853 | 3/1984 | Numbers | 108/96 X |

FOREIGN PATENT DOCUMENTS

| | | | |
|---|---|---|---|
| 18145 | 5/1882 | Germany | 297/344.12 |
| 63666 | 8/1892 | Germany | 297/344.12 |
| 221436 | 9/1924 | United Kingdom | 297/344.12 |

*Primary Examiner*—Peter R. Brown
*Attorney, Agent, or Firm*—Ladas & Parry

[57] ABSTRACT

A complex chair device includes a first chair and a second chair telescoped in the first chair. The seat of the first chair has a central receiving hole in which the seat of the first chair is fitted. A plurality of notches are formed in the peripheral edge of the central receiving hole. An inwardly extending flange is formed on the wall which defines the central receiving hole. Each of the legs of the second chair has a plurality of positioning notches formed along its longitudinal axis. A part of each of the legs of the second chair engages one of the notches of the seat of the first chair so that the second chair can be securely connected to the first chair by means of moving the second chair relative to the first chair and by means of rotating the second chair about its central axis when the inwardly extending flange of the first chair is aligned with and received in the positioning notches which are spaced from the seat of the second chair at the same distance.

3 Claims, 5 Drawing Sheets

COMPLEX CHAIR DEVICE

BACKGROUND OF THE INVENTION

1. Field of the Invention

This invention relates to a chair, more particularly to a complex chair device which is formed of a first chair and a second chair telescoped in a central receiving hole of the seat of the first chair.

2. Description of the Related Art

In case when a person wants to fix or take something at an elevated position, ladders are usually utilized in order to allow the person to reach the elevated workplace. In some cases, the person uses a table and a chair which stacked on the table in order to reach the elevated workplace when a ladder is not available. However, because the bottom surface area of the chair is small and the stability of the chair is poor, the chair stacked on the table is liable to fall when the person stands on the chair.

SUMMARY OF THE INVENTION

It is therefore a main object of this invention to provide a complex chair device which has a first chair and a second chair which is telescoped to and may be lifted up from the first chair to an elevated position and may be stably and firmly connected to the first chair in the elevated position.

Accordingly, the complex chair device of this invention comprises:

a first chair having a seat and a central receiving hole formed in the seat, the seat having a wall face defining the central receiving hole, an upper face and a lower face, the upper face of the seat of the first chair having a plurality of equally spaced notches formed along a peripheral edge of said wall face, the lower face of the seat of the first chair having a plurality of legs connected thereto, the wall face of the seat of the first chair having an inwardly extending flange so as to form a shoulder in the central receiving hole; and a second chair having a seat which is configured and sized to be received in the central receiving hole of the first chair and to rest on the shoulder of the first chair, the seat of the second chair having a plurality of legs extending from a lower face thereof, the number of the legs of the second chair equalling the number of the notches of the seat of the first chair, each of the legs of the second chair having a predetermined number of positioning notches spaced along its longitudinal axis, each of the positioning notches having a width which is greater than the thickness of the seat of the first chair, so that a part of each of the legs of the second seat can engage one of the notches of the seat of the first chair by means of moving the second chair relative to the first chair in order to allow the inwardly extending flange of the first chair to be aligned with and received in the positioning notches of the legs of the second chair which is space from the seat of the second chair at the same distance and by means of rotating an angle about a central axis of the chair axis, whereby the seat of the second chair can be adjustably and lockably positioned with respect to the seat of the first chair.

Other features and advantages of this invention will become apparent in the following detailed description of the preferred embodiments of this invention with reference to the accompanying drawings.

DETAILED DESCRIPTION OF THE PREFERRED EMBODIMENTS

Figure 1:
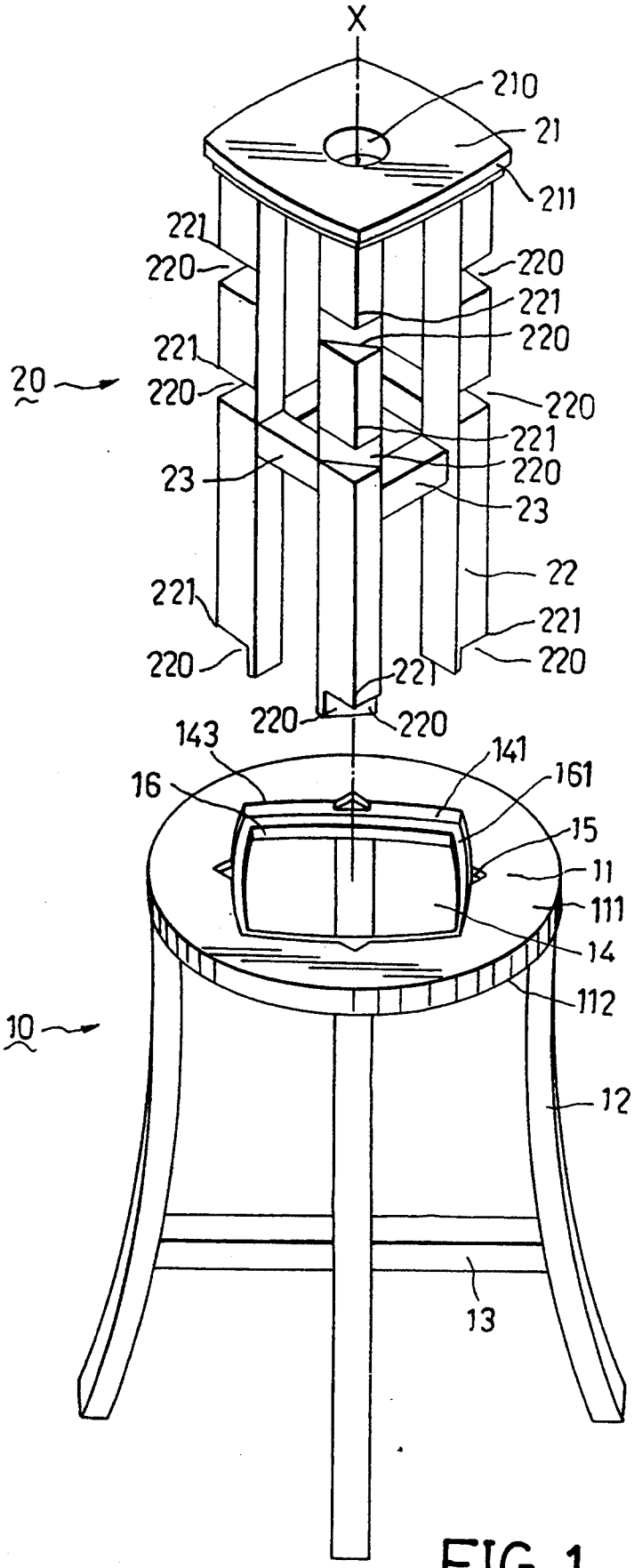
FIG. 1 is a perspective exploded view of a preferred embodiment of a complex chair device of this invention.

FIG. 1 shows a perspective exploded view of a preferred embodiment of a complex chair device of this invention. The complex chair device includes a first chair 10 and a second chair 20 which is telescoped in the first chair 10.

The first chair 10 has a seat 11 and a central receiving hole 14 formed in the seat 11. The upper face 111 of the seat 11 of the first chair 10 has four equally spaced notches 15 formed along the peripheral edge 143 of the wall face 141 which define the central receiving hole 14. The lower face 1112 of the seat 11 of the first chair 10 (see FIG. 3) has four legs 12 connected thereto. The legs 12 are interconnected by stretchers 13. The wall face 141 of the seat 11 of the first chair 10 has an inwardly extending flange 16 so as to form a shoulder 161 in the central receiving hole 14.

A second chair 20 has a seat 21 which is configured and sized to be received in the central receiving hole 14 of the first chair 11 and to rest on the shoulder 161 of the first chair 10. The seat 21 of the second chair 20 has four legs 22 extending from the periphery of the lower face 212 (see FIG. 3) of the seat 21. The legs 22 of the second chair 20 are interconnected by stretchers 23. It is noted that the number of the legs 22 of the second chair 20 equal the number of the notches 15 of the seat 11 of the first chair 10. The seat 21 of the second chair 20 has a central opening 210 which is adapted be inserted by a user's fingers for grasping purposes. A peripheral flange 211 is formed along the upper portion of peripheral edge of the seat 21. Therefore, the peripheral flange 221 of the seat 21 of the second chair 20 can rest on the shoulder 161 of the first chair 10 when the seat 21 of the second chair 20 is received in the central receiving hole 14 of the first chair, as shown in FIG. 4.

Figure 2:
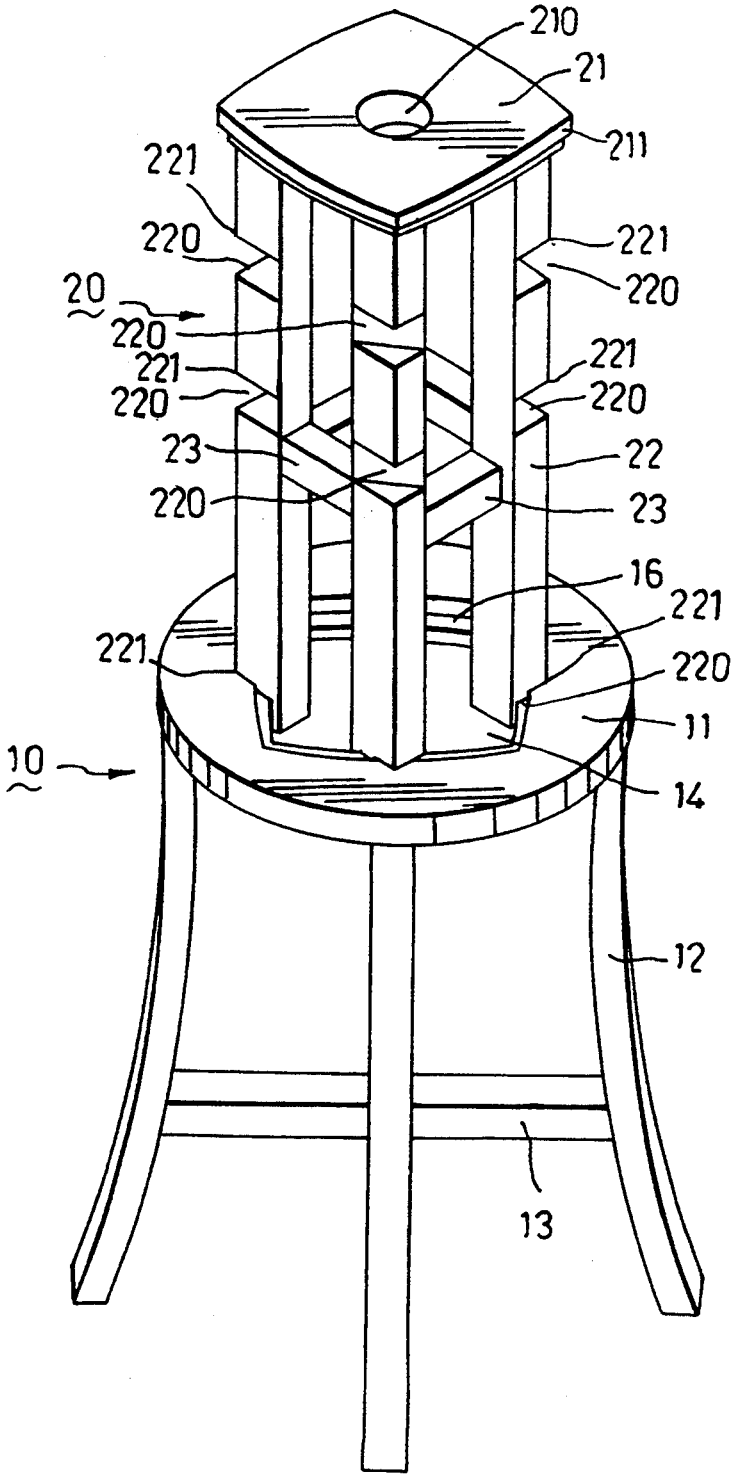
FIG. 2 is a perspective schematic view illustrating the second chair of the complex chair device of this invention being lifted up from the first chair and stably positioned on the first chair.
Figure 3:
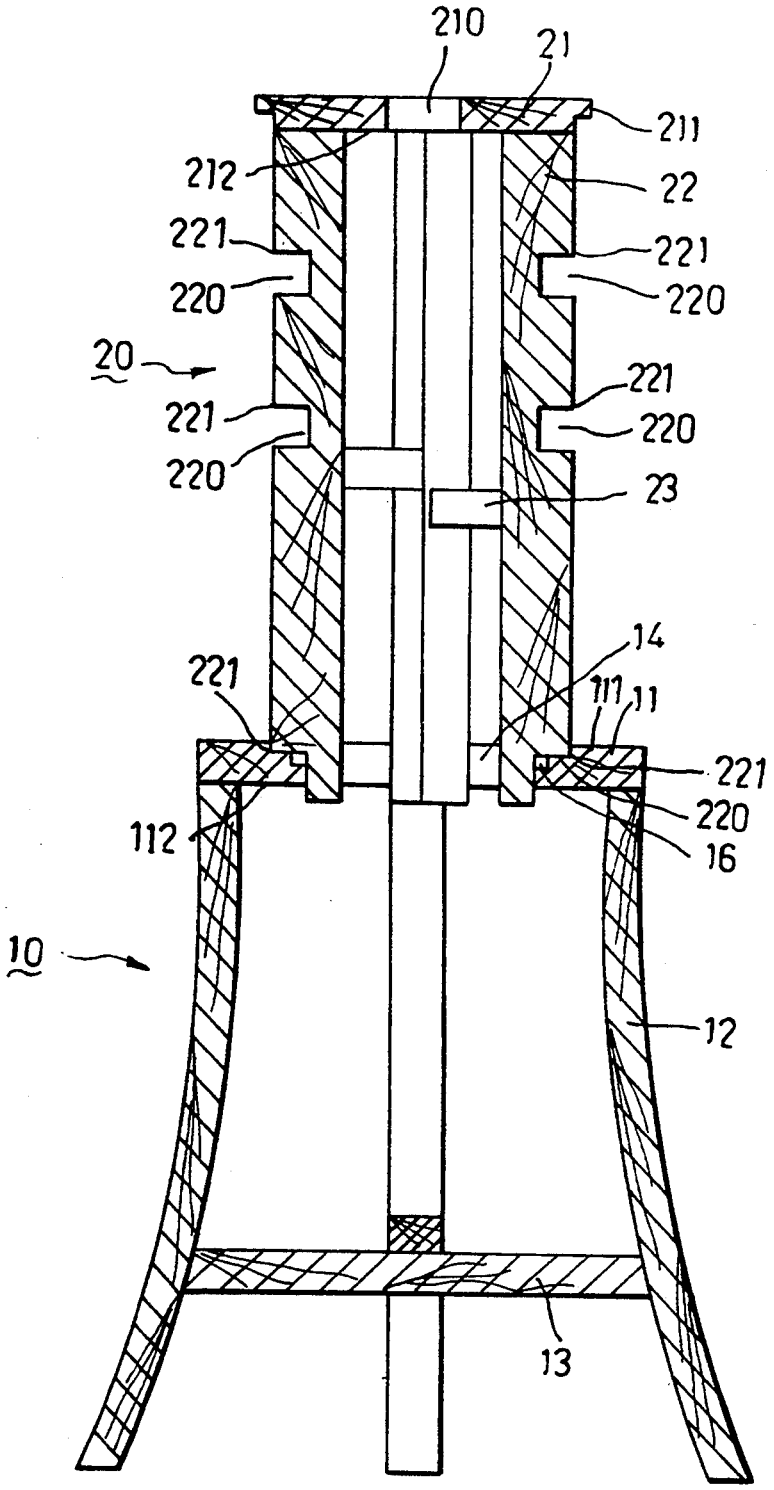
FIG. 3 is a longitudinal sectional view of the complex chair device of this invention of FIG. 2.
Figure 4:
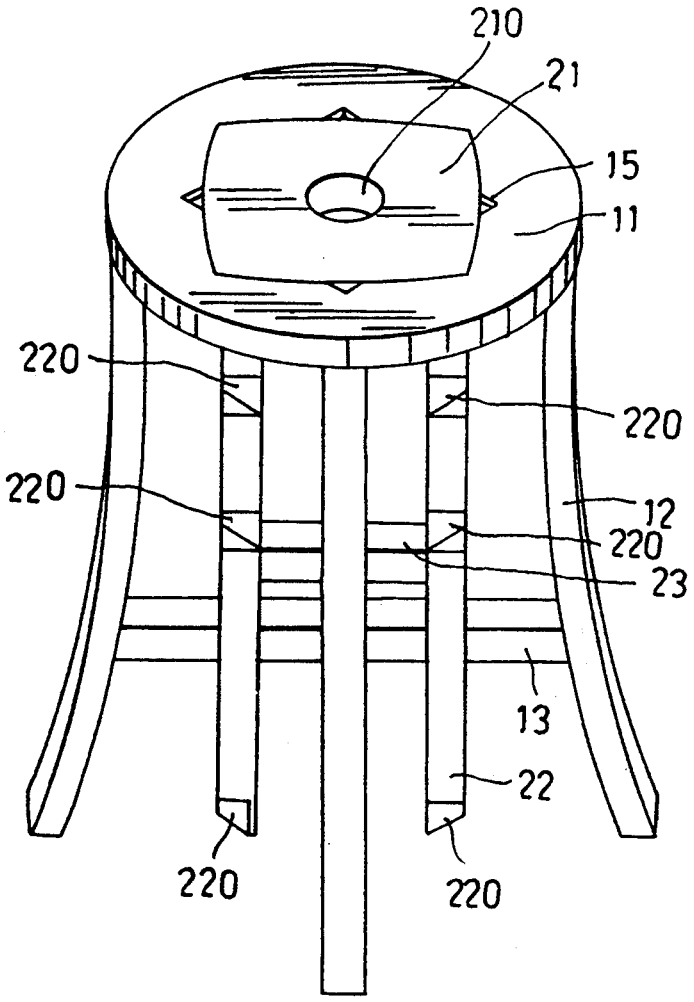
FIG. 4 is a perspective schematic view illustrating the second chair of the complex chair device of this invention being received into the first chair.

Referring now to FIGS. 2 and 3, each of the legs 22 of the second chair 20 has a predetermined number of positioning notches 220 spaced along its longitudinal axis. The width of each of the positioning notches 220 is greater than the thickness of the seat 11 of the first chair 10. Therefore, a part, i.e., the corner 221, of each of the legs 22 of the second seat 21 can engage one of the notches 15 of the seat 11 of the first chair 10 by means of moving the second chair 20 relative to the first seat in order to allow the inwardly extending flange 16 of the first chair 10 to be aligned with and received in the positioning notches 220 of the legs 22 of the second chair 20 which are spaced from the seat 21 of the second chair at the same distance and by means of rotating an angle about the central axis (X) of the second chair 20. Whereby, the seat 21 of the second chair 20 can be selectively and adjustably spaced from the seat 11 of the first chair 10. In this way, the complex chair device of this invention can be used as a normal chair when the seat 21 of the second chair 20 is received in the central receiving hole 14 of the first chair, as best illustrated in FIG. 4. On the other hand, the complex chair device of this invention can be used as an extension ladder when the second chair 20 is lifted up from the first chair 10 and is positioned in a manner as described above, as best illustrated in FIG. 2. Hence, a person can utilize the complex chair device of this invention in order to reach an elevated workplace for fixing, painting, etc. purposes. It is found that the second chair 20 may be secured firmly to the first chair 10 by means of engaging the corners 221 of the legs 22 of the second chair 20 and the notches 15 of the first chair 10.

Figure 5:
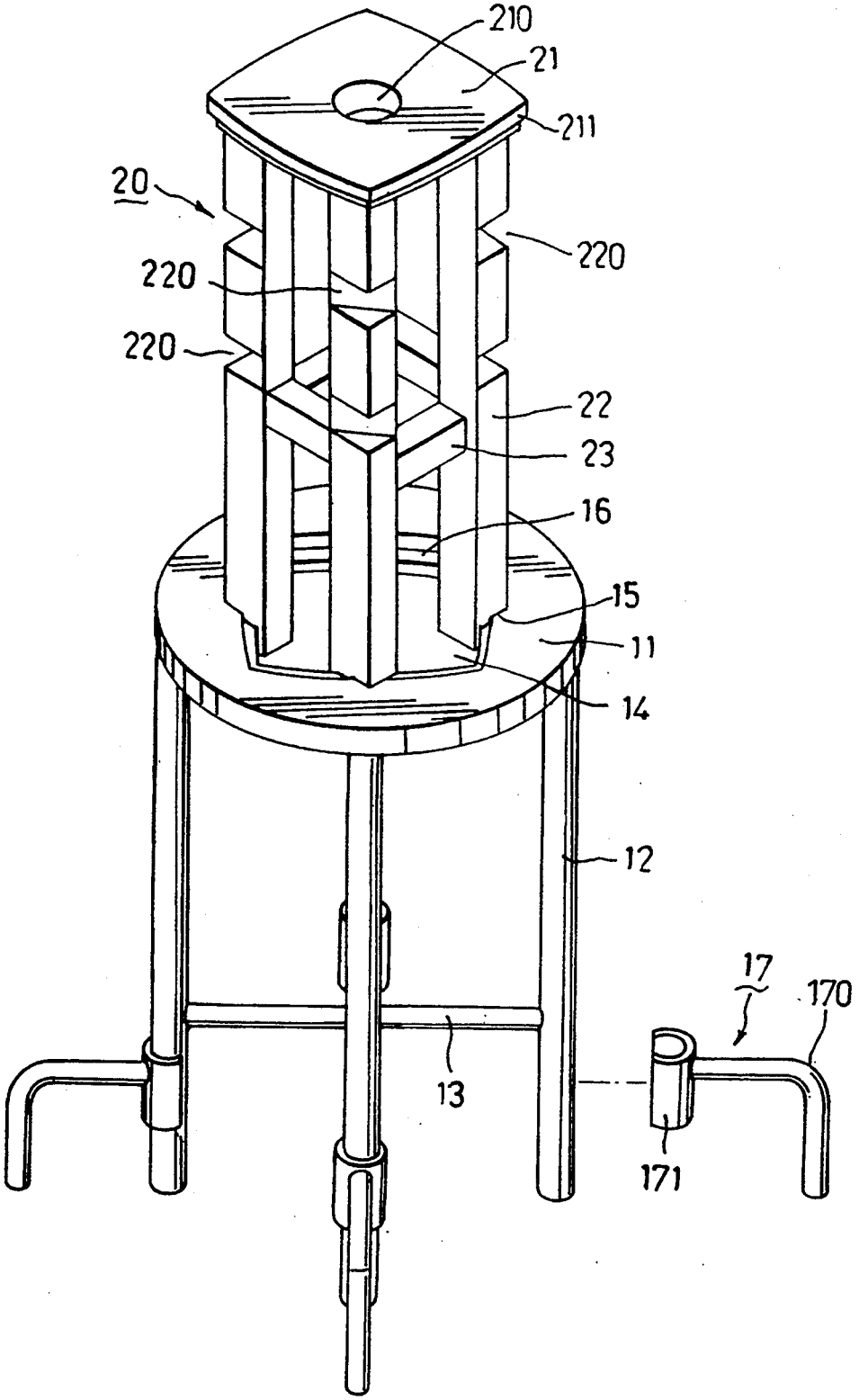
FIG. 5 is a partially exploded, perspective schematic view of another preferred embodiment of a complex chair device of this invention.

FIG. 5 shows a perspective, partially exploded view of a second preferred embodiment of a complex chair device of this invention. In this embodiment, the structure of the first and second chairs is similar to that of the first and second chairs of the first embodiment except that each of the legs 12 of the first chair 10 has an auxiliary supporting legs 17 detachably connected thereto. Each of the supporting legs 17 includes an L-shaped tube 170 and a C-shaped clamp 171 which is connected to an end of the L-shaped tube 170. The C-shaped clamp 171 may be clamped onto the legs 12 of the first chair 10 in order to increase the stability of the first chair 10.

With this invention thus explained, it is apparent that numerous modifications and variations can be made without departing from the scope and spirit of this invention. It is therefore intended that this invention be limited only as indicated in the appended claims.

I claim:

1. A complex chair device comprising:

a first chair having a seat and a central receiving hole formed in said seat, said seat having a wall face defining a perimeter of said central receiving hole, an upper face and a lower face, said upper face of said seat of said first chair having a plurality of equally spaced notches formed along a peripheral edge of said wall face, said lower face of said seat of said first chair having a plurality of legs connected thereto, said wall face of said seat of said first chair having an inwardly extending flange so as to form a shoulder in said receiving hole; and a second chair having a seat which is configured and sized to be received in said central receiving hole of said first chair and to rest on said shoulder of said first chair, said seat of said second chair having a plurality of legs extending from a lower face thereof, the number of said legs of said second chair equalling the number of said notches of said seat of said first chair, each of said legs of said second chair having a predetermined number of positioning notches spaced along its longitudinal axis, each of said positioning notches having a width which is greater than the thickness of said seat of said first chair, so that a part of each of said legs of said second seat can engage one of said notches of said seat of said first chair by means of rotating said second chair relative to said first chair about a central axis thereof in order to allow said inwardly extending flange of said first chair to be aligned with and received in selected ones of said positioning notches of said legs of said second chair said selected ones of said positioning notches being spaced from said seat of said second chair at the same distance, whereby said seat of said second chair can be adjustably and lockably positioned in a plurality of vertical positions with respect to said seat of said first chair.

2. The complex chair device as claimed in claim 1, wherein said seat of said second chair has a central opening formed therein.

3. The complex chair device as claimed in claim 1, wherein each of said legs of said first chair has an auxiliary supporting leg detachably connected thereto in order to increase the stability of said first chair.

* * * * *